United States Patent [19]

Sheldon

[11] Patent Number: 4,589,158

[45] Date of Patent: May 20, 1986

[54] ARTICLE CLEANING DEVICE FOR REMOVING SURFACE CONTAMINANTS FROM THE ARTICLE BY BRUSHING AND LIQUID CONTACT

[76] Inventor: Morris Sheldon, 158 Hoffman St., Nevada City, Calif. 95959

[21] Appl. No.: 652,000

[22] Filed: Sep. 19, 1984

[51] Int. Cl.[4] ..... A46B 13/04

[52] U.S. Cl. ..... 15/21 D; 134/111

[58] Field of Search ..... 15/21 R, 21 B, 21 C, 15/21 D, 21 E, 24, 29, 56, 4; 134/111, 172

[56] References Cited

U.S. PATENT DOCUMENTS

| | | | |
|---|---|---|---|
| 2,340,679 | 2/1944 | Moore | 15/21 R X |
| 2,392,237 | 1/1946 | Falese | 15/21 D |
| 2,942,284 | 6/1960 | Luker | 15/56 |
| 3,264,675 | 8/1966 | DiIlio | 15/56 |
| 3,295,539 | 1/1967 | Schlageck | 134/111 |
| 4,029,115 | 6/1977 | Wheeler | 134/111 |
| 4,105,342 | 8/1978 | Plourde | 134/111 |
| 4,226,548 | 10/1980 | Reith | 134/111 |

*Primary Examiner*—Edward L. Roberts
*Attorney, Agent, or Firm*—Leonard Bloom

[57] ABSTRACT

An article cleaner for removing surface contaminants from the article comprising a basin adapted to receive a cleaning liquid therein, a brush instrumentality perched above a lip of said basin, a cleaning liquid conduit and pump instrumentality recirculating the cleaning liquid from said basin to a nozzle supported adjacent said brush instrumentality for enhanced cleaning, an instrumentality for scavenging said recirculating cleaning liquid just below the surface of the cleaning liquid to preclude contaminant recirculation, an instrumentality for reorienting said brush instrumentality to different angles of attack so that widely disparate articles can be accommodated by the cleaner, and an instrumentality for filtering contaminants from the cleaning liquid just above the surface of the cleaning liquid to preclude contaminant recirculation.

18 Claims, 7 Drawing Figures

ARTICLE CLEANING DEVICE FOR REMOVING SURFACE CONTAMINANTS FROM THE ARTICLE BY BRUSHING AND LIQUID CONTACT

BACKGROUND OF THE INVENTION

The following invention relates generally to a machine which recirculates a cleaning liquid combined with a plurality of brushes oriented above a reservoir-type basin to facilitate the removal of contaminants such as grease, grime or the like from articles to be cleaned.

The facile, expeditious removal of surface grit and grime from parts in the mechanical, electrical and other fields has long been recognized. Enhanced cleaning has been experienced by the combination of brushing and liquid application, the liquid sometimes containing a detergent and adapted to be recirculated for economy.

The following citations reflect the state of the art of which applicant is aware insofar as these citations appear relevant to the process at hand.

| U.S. Pat. No. | Inventor | Issue Date |
|---|---|---|
| 2,392,237 | Falese | Jan. 1, 1946 |
| 3,585,668 | Jaccodine, et al. | June 22, 1971 |
| 3,648,315 | Hash | March 14, 1972 |
| 3,748,677 | Frank, et al. | July 31, 1973 |
| 3,970,471 | Bankes, et al. | July 20, 1976 |

Thus, it is known in the prior art to provide a brushing mechanism having a liquid nozzle adjacent thereto and including recirculation of liquid as taught in Falese.

Hash makes it known to provide a cleaning mechanism in which a plurality of brushes are jointly supported on a common axle.

The remaining citations show the state of the art further and are directed generally to the admixture of a liquid and detergent at or above the working brush.

More particularly, it is manifest that the instant application is distinguished over the known prior art when considered either singly or any conceivable combination in that an instrumentality has been provided for cleaning parts that involves the recirculation of detergent and a liquid, the position of the scavenging device being strategically located to preclude the contamination of the recirculation system by the dirt particles, grime, grease, et cetera, which are indigenous to the articles being cleaned. In addition, an instrumentality is provided for the articulation of a plurality of brushes so that the angle of attack of these brushes can be modified in accordance with, and with respect to, the articles being cleaned.

Moreover, by strategic placement of the cleanser containing liquid on the brush itself, the use of biodegradeable detergents for parts cleaning is possible. Heretofore analogous cleaning systems require the use of alkaline substances such as sodium silicate to achieve a similar result which provides waste disposal problems. Also, intricate, high tolerance parts have been cleaned with freon agents to assure no film buildup, and cleaning with freon is substantially more expensive. Thus, a long-felt, yet heretofore unsatisfied need exists.

SUMMARY AND OBJECTS OF THE INVENTION

Accordingly, this invention has as its primary objective the provision of a new and novel cleaner to remove contaminants from articles.

It is a further object of this invention to provide a device as characterized above which recirculates the cleaning solution such that the contaminants removed from the article do not get recirculated.

It is yet another object of this invention to provide a device as characterized above in which the angle of attack of the brushes can be expeditiously altered so that the brushes can address the parts to be cleaned in an optimum manner.

A further object of this invention contemplates providing a device as characterized above which includes a means for attaching a plurality of additional brush members, one of which is hand held and another of which, in a preferred form, is mounted on a top lip of a basin within which the liquid is disposed, to provide flexibility in cleaning parts of different dimensions.

A further object of this invention contemplates providing a device as characterized above in which a splash plate is provided and adapted to articulate with the brushes so as to deflect resulting spray back into the catch basin for its intended benefits.

A further object of this invention contemplates providing a device as characterized above in which a safety stop nozzle is provided adjacent the brushes to preclude the passage of the article to be cleaned to the interior of a brush compartment for safety purposes and to keep liquid cleaner on the brush continuously.

In its narrower aspects, the invention includes a basin supported above a substrate by a plurality of legs, the basin having a liquid contained therein. A float is carried on the liquid so that, in depending relationship relative to the surface of the liquid, a scavenging line including a mesh screen is provided which removes liquid from the basin beyond one of the walls of the basin and thereafter adjacent a brush or brushes. The brushes are in turn carried on a support plate and driven by a suitable motor through a belt drive. The support plate is adapted to be angulated about an axis and thereby alters the angle of attack of the brushes carried thereon. The conduits providing recirculation of the liquid include nozzles disposed towards the brushes also carried on the support plate. A protective, overlying housing keeps liquid and dirt from contaminating the drive mechanism associated with the brushes and motor. In a more particular aspect of the invention, a removable filter tray is suspended from a top edge of the basin, the filter tray including upper and lower wire meshes between which is disposed foam and paper filter above the level of the liquid so that a first filtering action of the particulate matter removed from the article is provided. A heating element is adapted to pass beyond the tray and into the liquid for enhanced cleaning properties as will be described. In one form, the shaft which supports the brushes driven by the motor has a threaded end adapted to receive a rotatable cable contained within a housing which has, in turn, at a distal end thereof, a further brush and liquid nozzle for hand manipulation. The top lip of the basin also serves to support a rod extending upwardly therefrom carrying a drill at a topmost extremity, the drill having a working shaft and brush with a liquid nozzle extending downwardly therefrom towards and overlying the liquid in the basin.

Other objects will be made manifest when considering the following detailed specifications when taken in conjunction with the appended drawing figures.

DESCRIPTION OF THE DRAWING FIGURES

DESCRIPTION OF THE PREFERRED EMBODIMENT

Figure 1:
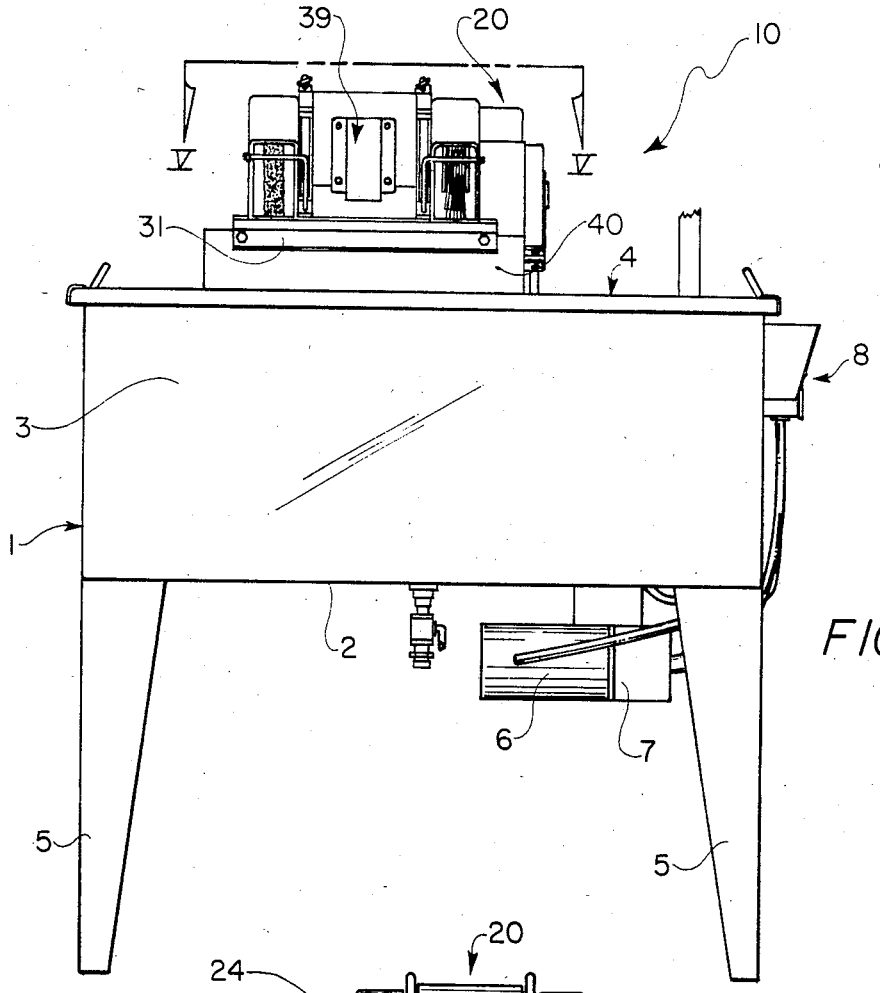
FIG. 1 is a front view of the apparatus according to the present invention.

Referring to the drawings now, where like reference numerals refer to like parts throughout the drawing figures, reference numeral 10 is directed to the parts cleaner according to the present invention.

As shown in the drawing figures, the parts cleaner 10 includes a basin 1 having a bottom wall 2, four side walls 3 and an open top wall 4 defining a receptacle within which liquid can be disposed.

Liquid L is adapted to be carried within the basin at a predetermined depth. The liquid, in a preferred form, is predominantly water with a relatively small percentage (approximately 2%) being a known biodegradeable detergent which is nonflammable. Of course, different cleaning operations may require the replacement of the liquid contained therewithin and is not to be construed as a limitation. In any event, the basin 1 is supported in an elevated horizontal manner by means of a plurality of downwardly depending legs 5. When the basin is of rectangular configuration, four legs at the corners are provided.

An external bottom face of the bottom wall 2 supports in depending relationship a pump motor 6 which includes an impeller 7. The impeller 7 is adapted to communicate with the interior of the basin just below the liquid level so as to circulate liquid from the basin to a brushing area to be disclosed. More particularly, the interior of the basin includes, on the bottom wall 2, an elbow 16 having a conduit 13 at one end of which a screened filter inlet 14 is provided. The filter inlet 14 is carried just below the surface level by means of a float 15 strapped on a supporting collar of the fluid inlet 14. In this manner, liquid is scavenged from an area just below the surface of the water and heavy particulate contaminants can precipitate to the bottom wall 2 of the basin. Upon leaving the basin through the elbow 16, the liquid is directed through the impeller 7 and, via a conduit 17, terminates in a manifold including a plurality of outlet nozzles 41 in a manner to be defined.

Figure 5:
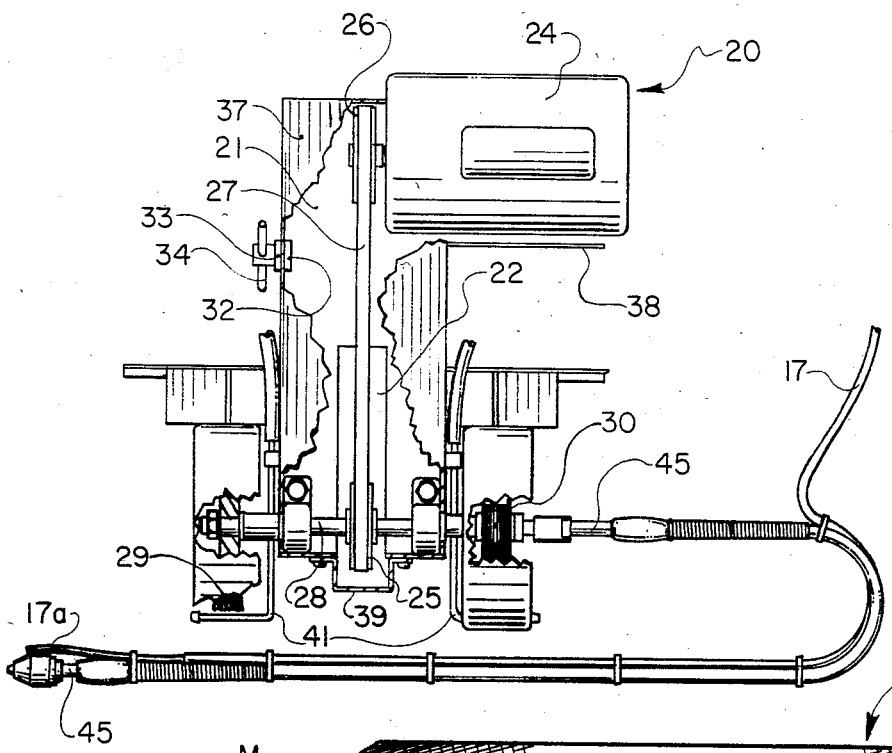
FIG. 5 is a partial top plan view, partially fragmented for clarity.

FIGS. 1 and 5 also reflect a view of the brush mechanism generally designated as 20. The brush mechanism includes a support plate 21 of substantially rectangular configuration having a recess 22 disposed at a leading edge as it faces the basin. The recess provides an area to support a first sheave 25 which is carried on an axle 28 having threaded extremities in a manner to be defined. More particularly, the axle is suitably supported by bearings, so that rotation of the axle 28 through the sheave 25 causes concomitant rotation of brushes 29 and 30 being carried on either side of the sheave 25 and supported by the axle 28. Appropriate washers, bearings and stop nuts are provided to render the device stable in use.

Figures 3, 4:
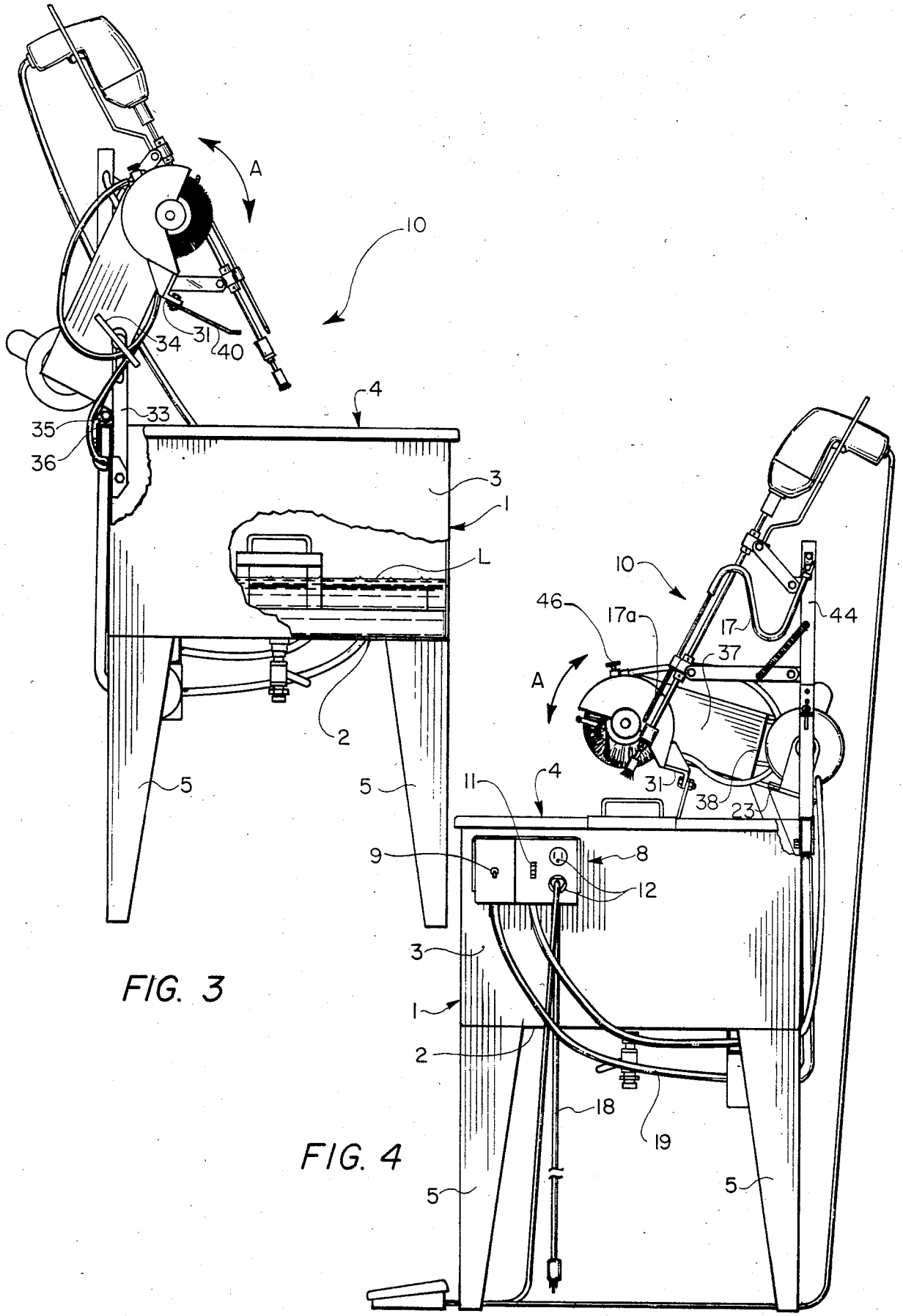
FIG. 3 is a side view from the left of FIG. 1.
FIG. 4 is the opposite side view.

An extremity of the support plate remote from the recess 22 includes a motor 24 carried on first and second motor support brackets 23 positioned on one side of the support plate 21. An associated sheave 26, in cooperation with a belt 27, allows power communication between the motor 24 and the axle sheave 25. A bottom surface of the support plate 21 carries, at a leading edge thereof, an L-shaped bracket 31 for structural support. First and second combined valved nozzle safety stops 41 of substantially L-shaped configuration are carried on the support plate 21 for purposes to be assigned later. A wall 3 of the basin 1 has on an inner face thereof an upwardly extending slotted bracket 33 (see FIGS. 3 and 5). Said bracket 33 is adapted to communicate with a retainer bolt 34 and with an upwardly extending ear 32 being carried on the support plate 21 so that vertical adjustment of the support plate 21 (and therefore the brushes) can be effected adjacent the leading edge of the support plate. An end of the plate 21 remote therefrom includes first and second downwardly extending ears through which a support pivot 35 is carried. The pivot 35 is supported on a top edge of the basin wall 31 by means of pivot rod 36. Thus, a stable support for the support plate 21 is provided along with the ability to articulate the brushes about the pivot 35. FIGS. 3 and 4 show the brushes in two extreme positions.

Each of the brushes 29 and 30 can be provided with the requisite stiffness and resiliency to perform the functions for which they were intended. The brushes may have different characteristics, so that one is more readily accommodated for rough work, the second being tailored for more detailed work.

A control panel 8 is provided which allows current to be directed, as desired, to different components of the mechanism. For example, the panel 8 may include a pump switch 9 providing energization of the pump thereat, and a three position switch 11 for the motor 24 that in turn drives the brushes. The brush switch 11 and pump switch 9 are adjacent AC outlets 12 which can serve to drive other accessories as will be defined shortly. Current is provided to the control panel 8 by means of an AC line 18. The pump power line is shown at 19.

As shown in the rear left hand corner of the basin, a heater 43 can be provided having a control box and a downwardly extending heating element which terminates in a horizontal arcuate resistive portion. The heater can find power from the AC outlets 12.

Figure 2:
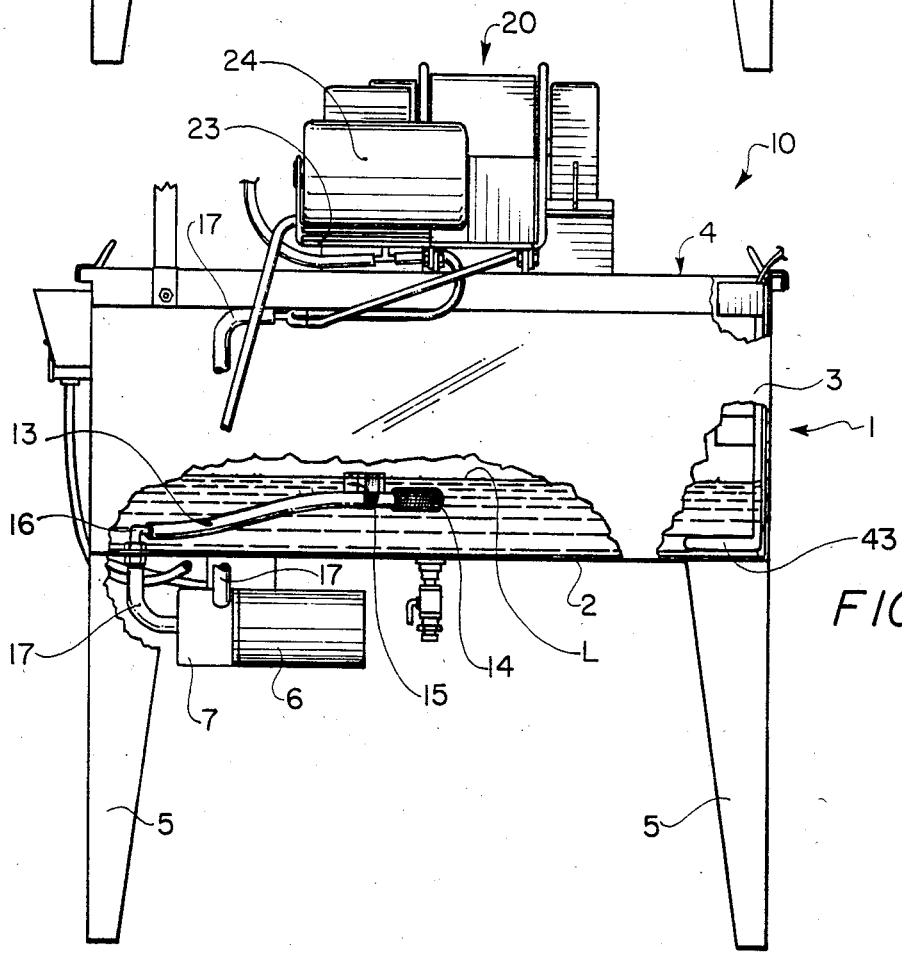
FIG. 2 is a rear view thereof partially fragmented for clarity.
Figure 6:
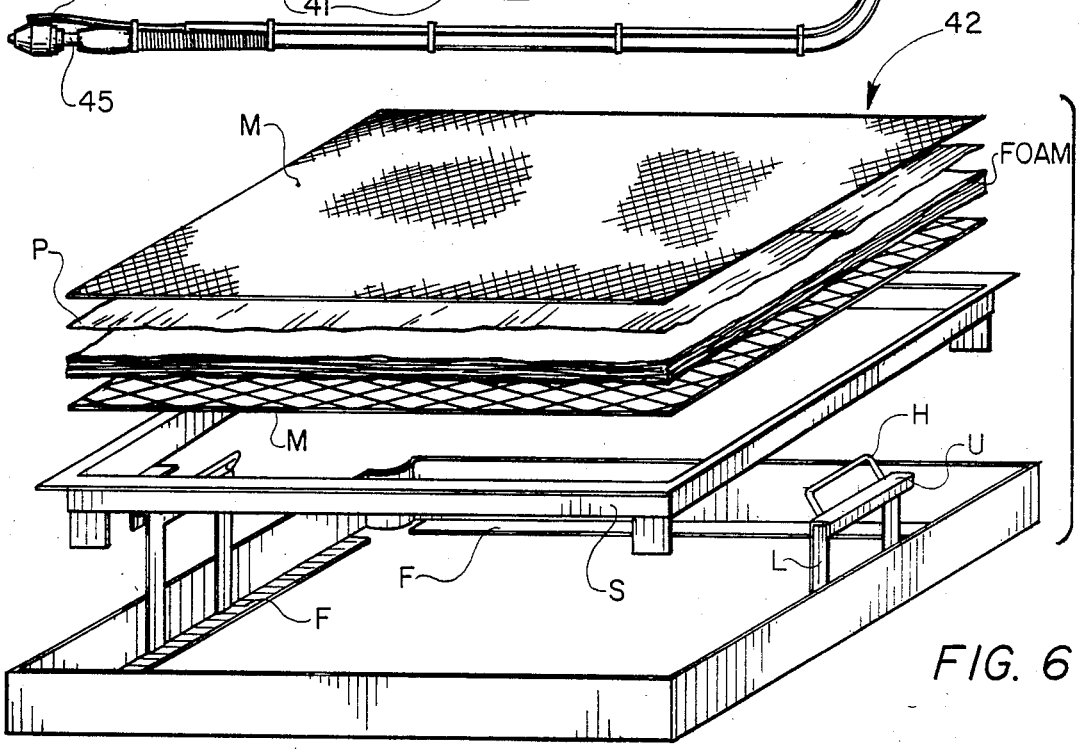
FIG. 6 is an exploded perspective of a tray forming part of the invention.
Figure 7:
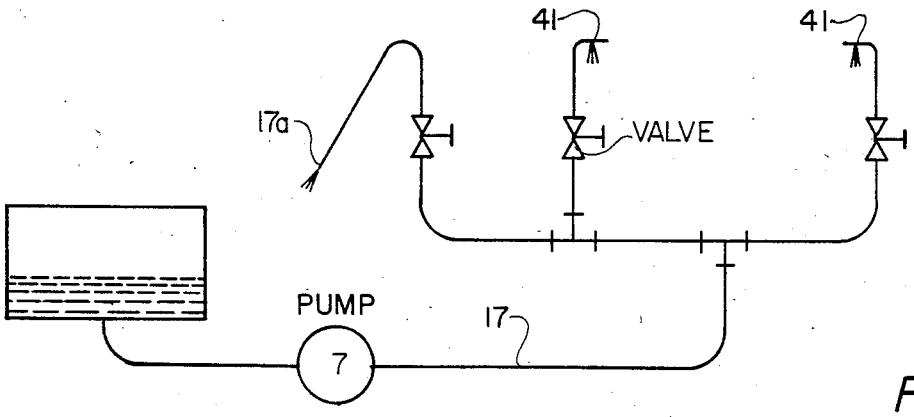
FIG. 7 is a liquid flow diagram.

A filter tray 42 (see FIG. 6) is provided with an opening in the upper left hand corner to accommodate the downward passage of the heater 43. The filter tray 42 is suspended from an upper peripheral lip of the basin 1 by means of U-shaped clasps U overlying the lip. Each of the clasps has a handle H and downwardly extending legs L on an inner portion of the basin communicating with a rectangular framework F of the tray 42 supporting a wire mesh M on a tray shelf S. Overlying the wire mesh is first a foam filter, then a paper filter D, followed by another mesh layer M so that liquid coming from the nozzles 41 will first land on the mesh, paper and foam, respectively, and then will pass, through the lower wire mesh, and into the liquid so that major particulate matter is initially removed. In a preferred form of the invention, the filter tray 42 is positioned above the liquid level (FIG. 2) or in the liquid (FIG. 3).

The brush mechanisms are encased partially in a housing having an arcuate contour on a top and rearward portion thereof fastened to support plate 21. The valved nozzle safety stops 41 extend towards the basin from plate 21 and then laterally outwardly across the brushes. These safety stops 41:C1) impedes the progress of the articles to be cleaned from between the housing and the brush while; (2) delivering liquid to the brush via outlets facing the brush including valves 46 to control liquid flow. In addition, a further housing 37 of substantially rectangular configuration having a forward U-shaped cutout is provided, the cutout serving to provide clearance for the sheave 25. In turn, the sheave 25 is protected by a contoured pulley plate 39 having a central portion of arcuate configuration corresponding to the radius of curvature of the sheave. The rectangular housing has a side wall with a portion cut away and bent transverse to the longitudinal extent of the housing, the bent portion 38 serving as a motor baffle to preclude the migration of liquid against the motor. Depending from a bottom surface of the support plate 21, and just rearward of the L-shaped bracket 31, a downwardly extending resilient splash plate 40 is provided to direct the splattered liquid and debris onto the filter tray 42.

As shown in FIG. 5, the axle 28 has threaded ends, one end of which is clearly visible and is adapted to have a threaded extremity accomodate a power takeoff implement 45 formed from a drive cable drivingly engaged by the axle 28 and covered by an overlying shroud. The implement 45 has a remote end with a chuck adapted to receive any of a plurality of brushes for hand held convenience. In this event, a further nozzle 17*a* is provided adjacent the hand held brush. Along with a fluid outlet line 17, said further nozzle 17*a* provides for benefits similar to that which had been delineated hereinabove.

In FIG. 4, an upwardly extending support rod 44 is clamped on a top lip of the basin by means of a C-clamp or its equivalent to support a drill carried at a top end of the rod 44. The drill has a downwardly extending shaft and a further brush at a distal end thereof overlying the basin. Liquid cleaning conduits 17 and nozzle 17*a* can be provided thereat and the liquid for the power takeoff implement 45 can be derived from drill nozzle 17*a*. The drill support rod 44 further supports the drill shaft by two spaced braces extending therebetween and is operated by a foot pedal drive to the controls.

In use and operation, liquid is recirculated through the fluid inlet 14 and directed through the nozzles 41, 17*a*. The brushes 29 and 30 are adapted to be oriented in an arcuate path in the direction of the arrows A and the liquid is adapted to be heated through the heating element 43. The filter tray 42 precludes the migration of large particles into the liquid, so that an extremely economical means has been provided for the utilization of a small amount of detergent in combination with a rather large supply of cleaning liquid such, as water.

Having thus described the invention, it should be apparent that numerous structural modifications are contemplated as being a part of this invention as set forth hereinabove and as defined hereinbelow by the claims.

What is claimed is:

1. An article cleaner for removing surface contaminants from the article comprising in combination:

a basin adapted to receive a cleaning liquid therein;

brush means perched above a lip of said basin;

cleaning liquid conduit and pump means recirculating the cleaning liquid from said basin to a nozzle supported adjacent said brush means for enhanced cleaning;

means for scavenging said recirculating cleaning liquid just below the surface of the cleaning liquid to preclude contaminant recirculation; and means for orienting said brush means to different angles of attack including a support plate having means thereon to support a motor at a rearward extremity carrying a sheave on an outward shaft thereof, a further sheave forward thereof and connected to said motor sheave by means of a pulley belt, said forward sheave supporting in turn an axle having said brush means positioned thereon being adapted to rotate with said sheave, distal ends of said axle provided with threaded extremities serving as power takeoff, a slotted bracket carried on said basin and extending upwardly therefrom adapted to be adjustably fastened to an ear extending upwardly from an upper surface of said support plate, a pivot on a rear area of said support plate adapted to allow the support plate to articulate thereabout, and means connecting said pivot to an outer surface of a wall of said basin whereby said brush means and said supporting plates can be angulated within the limits and constraints imposed by said slotted bracket.

2. The cleaner of claim 1, including means for filtering contaminants from the cleaning liquid just above the surface of the cleaning liquid to preclude contaminant recirculation.

3. The cleaner of claim 1, wherein said means for scavenging said recirculating cleaning liquid include a fluid inlet having a protective screen thereat supported below the level of the liquid by float means attached thereto, a line in fluid communication with said screen extending beyond said basin and operatively communicating with a pump including an impeller, said impeller directing liquid removed from the basin to a nozzle outlet.

4. An article cleaner for removing surface contaminants from the article comprising in combination:

a basin adapted to receive a cleaning liquid therein;

brush means perched above a lip of said basin;

cleaning liquid conduit and pump means recirculating the cleaning liquid form said basin to a nozzle supported adjacent said brush means for enhanced cleaning;

means for scavenging said recirculating cleaning liquid just below the surface of the cleaning liquid to preclude contaminant recirculation;

including means for reorienting said brush means to different angles of attack so that widely disparate articles can be accommodated by the cleaner; and including means for filtering contaminants from the cleaning liquid just above the surface of the cleaning liquid to preclude contaminant recirculation;

wherein said means for scavenging said recirculating cleaning liquid include a fluid inlet having a protective screen thereat supported below the level of the liquid bhy float means attached thereto, a line in fluid communication with said screen extending beyond said basin and operatively communicating with a pump including an impeller, said impeller directing liquid removed from the basin to a nozzle outlet; and wherein said means for orienting said brush means to different angles of attack include a support plate having means thereon to support a motor at a rearward extremity carrying a sheave on an outward shaft thereof, a further sheave forward thereof and connected to said motor sheave by means of a pulley belt, said forward sheave supporting in turn an axle thereon having the brush means adapted to rotate with said sheave, distal ends of said axle provided with threaded extremities serving as power takeoff, a slotted bracket carried on said basin and extending upwardly therefrom adapted to be adjustably fastened to an ear extending upwardly from an upper surface of said support plate, a pivot on a rear area of said support plate adapted to allow the support plate to articulate thereabout, and means connecting said pivot to an outer surface of a wall of said basin whereby said brush means and said supporting plates can be angulated within the limits and constraints imposed by said slotted bracket.

5. The cleaner of claim 4 wherein said means for filtering contaminants from the cleaning liquid include a filter tray depending from a peripheral lip on the upper edge of said basin, said filter tray having a peripheral framework supporting a wire mesh coextensive with the surface area of said liquid, filter paper overlying said wire mesh, and an an access means for providing a heating element to pass beyond the filter tray into the liquid.

6. An article cleaner for removing surface contaminants from the article comprising in combination:

a basin adapted to receive a cleaning liquid therein;

brush means perched above a lip of said basin;

cleaning liquid conduit and pump means recirculating the cleaning liquid from said basin to a nozzle supported adjacent said brush means for enhanced cleaning;

means for filtering contaminants from the cleaning liquid just above the surface of the cleaning liquid to preclude contaminant recirculation and;

means for orienting said brush means to different angles of attack including a support plate having means thereon to support a motor at a rearward extremity carrying a sheave on an outward shaft thereof, a further sheave forward thereof and connected to said motor sheave by means of a pulley belt, said forward sheave supporting in turn an axle having said brush means positioned thereon being adapted to rotate with said sheave, distal ends of said axle provided with threaded extremities serving as power takeoff, a slotted bracket carried on said basin and extending upwardly therefrom adapted to be adjustably fastened to an ear extending upwardly from an upper surface of said support plate, a pivot on a rear area of said support plate adapted to allow the support plate to articulate thereabout, and means connecting said pivot to an outer surface of a wall of said basin whereby said brush means and said supporting plates can be angulated within the limits and constraints imposed by said slotted bracket.

7. The cleaner of claim 6, wherein said means for filtering contaminants from the cleaning liquid include a filter tray depending from a peripheral lip on the upper edge of said basin, said filter tray having a peripheral framework supporting a wire mesh coextensive with the surface area of said liquid, filter paper overlying said wire mesh, and an access means for providing a heating element to pass beyond the filter tray into the liquid.

8. The device of claim 7, including means for scavenging said recirculating cleaning liquid just below the surface of the cleaning liquid to preclude contaminant recirculation.

9. The cleaner of claim 8, wherein said means for scavenging said recirculating cleaning liquid include a fluid inlet having a protective screen thereat supported below the level of the liquid by float means attached thereto, a line in fluid communication with a pump including an impeller, said impeller directing liquid removed from the basin to a nozzle outlet.

10. An article cleaner for removing surface contaminants from the article comprising in combination:

a basin adapted to receive a cleaning liquid therein;

a plurality of brushes perched above a lip of said basin;

cleaning liquid conduit and pump means recirculating the cleaning liquid from said basin to a nozzle supported adjacent said plurality of brushes for enhanced cleaning;

means for filtering contaminants from the cleaning liquid just above the surface of the cleaning liquid to preclude contaminant recirculation;

including means for scavenging said recirculating cleaning liquid just below the surface of the cleaning liquid to preclude contaminant recirculation;

wherein said means for scavenging said recirculating cleaning liquid include a fluid inlet having a protective screen thereat supported below the level of the liquid by float means attached thereto, a line in fluid communication with said screen extending beyond said basin and operatively communicating with a pump including an impeller, said impeller directing liquid removed from the basin to a nozzle outlet; and further including means for orienting said plurality of brushes to different angles of attack include a support plate having means thereon to support a motor at a rearward extremity carrying a sheave on an outward shaft thereof, a further sheave forward thereof and connected to said motor sheave by means of a pulley belt, said forward sheave supporting in turn an axle thereon having the plurality of brushes adapted to rotate with said sheave, distal ends of said axle provided with threaded extremities serving as power takeoff, a slotted bracket carried on said basin and extending upwardly therefrom adapted to be adjustably fastened to an ear extending upwardly from an upper surface of said support plate, a pivot on a rear area of said support plate adapted to allow the support plate to articulate thereabout, and means connecting said pivot to an outer surface of a wall of said basin whereby said plurality of brushes and said supporting plates can be angulated within the limits and constraints imposed by said slotted bracket.

11. The cleaner of claim 10 wherein said means for filtering contaminants from the cleaning liquid include a filter tray depending from a peripheral lip on the upper edge of said basin, said filter tray having a peripheral framework supporting a wire mesh coextensive with the surface area of said liquid, filter paper overlying said wire mesh, and an an access means for providing a heating element to pass beyond the filter tray into the liquid.

12. An article cleaner for removing surface contaminants from the article comprising in combination:

a basin adapted to receive a cleaning liquid therein;

brush means perched above a lip of said basin;

cleaning liquid conduit and pump means recirculating the cleaning liquid from said basin to a nozzle supported adjacent said brush means for enhanced cleaning; and means for orienting said brush means to different angles of attack so that widely desparate articles can be accommodated by said cleaner including a support plate having means thereon to support a motor at a rearward extremity carrying a sheave on an outward shaft thereof, a further sheave forward thereof and connected to said motor sheave by means of a pulley belt, said forward sheave supporting in turn an axle having said brush means positioned thereon being adapted to rotate with said sheave, distal ends of said axle provided with threaded extremities serving as power takeoff, a slotted bracket carried on said basin and extending upwardly therefrom adapted to be adjustably fastened to an ear extending upwardly from an upper surface of said support plate, a pivot on a rear area of said support plate adapted to allow the support plate to articulate thereabout, and means connecting said pivot to an outer surface of a wall of said basin whereby said brush means and said supporting plates can be angulated within the limits and constraints imposed by said slotted bracket.

13. The cleaner of claim 12, including means for filtering contaminants from the cleaning liquid just above the surface of the cleaning liquid to preclude contaminant recirculation.

14. The cleaner of claim 13, further including means for scavenging said recirculating cleaning liquid include a fluid inlet having a protective screen thereat supported below the level of the liquid by float means attached thereto, a line in fluid communication with said screen extending beyond said basin and operatively communicating with a pump including an impeller, said impeller directing liquid removed from the basin to a nozzle outlet.

15. An article cleaner for removing surface contaminants from the article comprising in combination:

a basin adapted to receive a cleaning liquid therein;

brush means including a plurality of brushes perched above a lip of said basin;

cleaning liquid conduit and pump means recirculating the cleaning liquid from said basin to a nozzle supported adjacent said brush means including a plurality of brushes for enhanced cleaning; and means for reorienting said brush means including a plurality of brushes to different angles of attack so that widely desparate articles can be accommodated by said cleaner further;

including means for filtering contaminants from the cleaning liquid just above the surface of the cleaning liquid to preclude contaminant recirculation;

means for scavenging said recirculating cleaning liquid including a fluid inlet having a protective screen thereat supported below the level of the liquid by float means attached thereto, a line in fluid communication with said screen extending beyond said basin and operatively communicating with a pump including an impeller, said impeller directing liquid removed from the hasin to a nozzle outlet; and wherein said means for orienting said brush means including a plurality of brushes to different angles of attack include a support plate having means thereon to support a motor at a rearward extremity carrying a sheave on an outward shaft thereof, a further sheave forward thereof and connected to said motor sheave by means of a pulley belt, said forward sheave supporting in turn an axle thereon having the brush means including a plurality of brushes adapted to rotate with said sheave, distal ends of said axle provided with threaded extremities serving as power takeoff, a slotted bracket carried on said basin and extending upwardly therefrom adapted to be adjustably fastened to an ear extending upwardly from an upper surface of said support plate, a pivot on a rear area of said support plate adapted to allow the support plate to articulate thereabout, and means connecting said pivot to an outer surface of a wall of said basin whereby said brush means including as plurality of brushes and said supporting plates can be angulated within the limits and constraints imposed by said slotted bracket.

16. The cleaner of claim 15 wherein said means for filtering contaminants from the cleaning liquid include a filter tray depending from a peripheral lip on the upper edge of said basin, said filter tray having a peripheral framework supporting a wire mesh coextensive with the surface area of said liquid, filter paper overlying said wire mesh, and an an access means for providing a heating element to pass beyond the filter tray into the liquid.

17. The cleaner of claims 1, 6 or 12, including a housing adapted to overlie said support plate and obscure said axle, sheaves and drive belts, a portion of said housing having an outwardly bent baffle interposed between the motor and said basin, an L-shaped bracket depending from a leading edge of said support plate for rigidification, a downwardly extending splash plate disposed beyond said L-shaped bracket and in depending relation to further redirect liquid back into the basin, first and second safety stops extending from said support plate on a top surface thereof, said safety stops of L-shaped configuration and having one leg placed in front of each said brush, brush housings disposed above said safety stops;

said basin formed from a bottom wall and four inwardly extending side walls to define a liquid enclosure having an open top wall; a heater element extending down into the liquid from one corner thereof, a control panel provided with a source of current and control switches adapted to energize said motor, said pump and said heater;

said threaded stems of said axle adapted to drivingly engage a cable connected thereto having an overlying shroud, said cable operatively connected to a further hand held brush, said hand held brush provided with a nozzle conduit;

and a stationary upwardly extending support clamp to an upper lip of said basin adapted to receive at a distal end thereof a further drill having an elongated shaft, means extending between said elongated shaft and said upwardly extending support to brace said elongated shaft, an end of said shaft remote from the drill provided with a further brush and a liquid nozzle.

18. In an article cleaner for removing surface contaminants from an article, wherein the cleaner has a basin adapted to receive a cleaning liquid therein, a nozzle means for dispensing cleaning liquid therefrom, a cleaning liquid conduit means positioned for fluid communication between the basin and the nozzle means, and a pump means for pumping the cleaning liquid from the basin through the conduit means and the nozzle means respectively, wherein the improvement comprises, in combination, brush means including at least one relatively-large brush and at least one relatively-small brush, means for adjustably raising and lowering said brush means in a vertical plane relative to the basin, means for pivotably mounting said brush means about an axis transverse to the vertical plane, whereby said brush means may be oriented to different angles for cleaning the article, and means for directing the cleaning liquid onto said brush means by the nozzle means.

* * * * *